United States Patent [19]

Grant

[11] 4,284,497

[45] Aug. 18, 1981

[54] ROTOR FOR SEDIMENTATION FIELD FLOW FRACTIONATION

[75] Inventor: John W. Grant, Chadds Ford, Pa.

[73] Assignee: E. I. Du Pont de Nemours and Company, Wilmington, Del.

[21] Appl. No.: 125,850

[22] Filed: Feb. 29, 1980

[51] Int. Cl.[3] ..... B03B 5/00

[52] U.S. Cl. ..... 209/155; 233/27

[58] Field of Search ..... 209/1, 155, 208, 444, 209/453, 11; 55/67, 81; 73/432 PS, 23.1; 210/198 C, 72; 233/1 R, 1 A, 1 D, 14 R, 23 R, 25, 26, 27

[56] References Cited

FOREIGN PATENT DOCUMENTS 2821056 12/1978 Fed. Rep. of Germany ..... 233/27

*Primary Examiner*—Ralph J. Hill

[57] ABSTRACT

A long, thin annular belt-like channel is designed for use in sedimentation field flow fractionation. This channel, which may be the rotor of a centrifuge, is designed to maintain its thickness dimension constant by forming the radially inner wall with a radial thickness that is about balanced by the centrifugal pressure of fluid in the flow channel.

4 Claims, 7 Drawing Figures

Computer
10
12
14
16
18
20
22
23
26
28
29
30
31
32
33
34
36
38
40
42
44
46
48
50
52
54
W
$b_B$
$b_A$

ROTOR FOR SEDIMENTATION FIELD FLOW FRACTIONATION

CROSS REFERENCE TO RELATED APPLICATIONS

This application is related to inventions described in copending applications Ser. No. 125,855, filed Feb. 29, 1980 entitled "Rotor for Sedimentation Field Flow Fractionation", by John Wallace Grant; Ser. No. 125,854, filed Feb. 29, 1980 entitled "Drive for Rotating Seal", by Charles Heritage Dilks, Jr.; Ser. No. 125,852, filed Feb. 29, 1980 entitled "Channel for Sedimentation Field Flow Fraction", by Charles Heritage Dilks, Jr., Joseph Jack Kirkland and Wallace Wen-Chuan Yau; Ser. No. 125,852, filed Feb. 29, 1980 entitled "Apparatus for Field Flow Fractionation", by John Wallace Grant, Joseph Jack Kirkland and Wallace Wen-Chuan Yau; and Ser. No. 125,851, filed Feb. 29, 1980 entitled "Method and Apparatus for Field Flow Fractionation", by Joseph Jack Kirkland and Wallace Wen-Chuan Yau.

BACKGROUND OF THE INVENTION

Sedimentation field flow fractionation is a versatile technique for the high resolution separation of a wide variety of particulates suspended in a fluid medium. The particulates including macromolecules in the $10^5$ to the $10^{13}$ molecular weight (0.001 to 1 μm) range, colloids, particles, micelles, organelles and the like. The techniques is more explicitly described in U.S. Pat. No. 3,449,938, issued June 17, 1969 to John C. Giddings and U.S. Pat. No. 3,523,610, issued Aug. 11, 1970 to Edward M. Purcell and Howard C. Berg.

Field flow fractionation is the result of the differential migration rate of components in a carrier or mobile phase in a manner similar to that experienced in chromatography. However, in field flow fractionation there is no separate stationary phase as is in the case of chromatography. Sample retention is caused by the redistribution of sample components between the fast to the slow moving strata within the mobile phase. Thus, particulates elute more slowly than the solvent front.

Typically a field flow fractionation channel, consisting of two closely spaced parallel surfaces, is used wherein a mobile phase is caused to flow continuously through the gap between the surfaces. Because of the narrowness of this gap or channel (typically 0.025 centimeters (cm)) the mobile phase flow is laminar with a characteristic parabolic velocity profile. The flow velocity is the highest at the middle of the channel and essentially zero at the two channel surfaces. An external force field of some type (the force fields include gravitational, thermal, electrical, fluid cross flow and others described variously by Giddings and Berg and Purcell), is applied transversely (perpendicular) to the channel surfaces or walls. This force field pushes the sample components in the direction of the slower moving strata near the outer wall. The buildup of sample concentration near the wall, however, is resisted by the normal diffusion of the particulates in a direction opposite to the force field. This results in a dynamic layer of component particles, each component with an exponential-concentration profile. The extent of retention is determined by the particulates time average position within the concentration profile which is a function of the balance between the applied field strength and the opposing tendency of particles to diffuse.

In sedimentation field flow fractionation (SFFF), use is made of a centrifuge to establish the force field required for the separation. For this purpose a long, thin, annular belt-like channel is made to rotate within a centrifuge. The resultant centrifugal force causes components of higher density than the mobile phase to sediment toward the outer wall of the channel. For equal particle density, because of higher diffusion rate, smaller particulates will accumulate into a thicker layer against the outer wall than will larger particles. On the average, therefore, larger particulates are forced closer to the outer wall.

If now the fluid medium, which may be termed a mobile phase or solvent, is fed continuously from one end of the channel, it carries the sample components through the channel for later detection at the outlet of the channel. Because of the shape of the laminar velocity profile within the channel and the placement of particulates in that profile, solvent flow causes smaller particulates to elute first, followed by a continuous elution of sample components in the order of ascending particulate mass.

In order to reduce the separation times required using this technique, it is necessary to make the channels relatively thin as noted. This creates many problems because, in order to maintain a high degree of resolution of the separated components of the sample, the channel must maintain a constant thickness during operation even when subjected to large centrifugal forces. This is not easily accomplished, particularly if the weight of the channel elements are to be maintained at reasonably small values for use in the centrifuge. The inner radial wall of the channel tends to bow radially outward when subjected to centrifugal force.

If the inner channel wall thickness t is too great the wall tends to bow radially outward into channel when subjected to centrifugal force. This is due to the fact that the centrifugal force on the wall exceeds the counter fluid pressure force pushing radially inward on the wall. Likewise, if the wall thickness t is too thin the wall will bow radially inward, opening up the channel, since in this case the pressure loading exceeds the wall centrifugal or body force. The degree of bowing or wall deflecting increases as the square of the rotational speed.

This wall deflection produces a variable channel radial width W which in turn is produces a nonuniform flow profile across the axial or width dimension of the flow channel. This nonuniformity in flow tends to first spread a sample population due to the difference in velocity across the width of the channel and secondly creates a nonuniform retention across the axial height of the flow channel. Both problems tend to vary as functions of rotor speed. This nonuniformity tends to degrade results considerably.

SUMMARY OF THE INVENTION

According to one aspect of this invention, an apparatus is constructed for separating particulates suspended in a fluid medium according to their effective masses. This apparatus includes an annular, cylindrical channel having a cylinder axis, means for rotating the channel about the axis, means for passing the fluid medium circumferentially through the channel and means for introducing the particulates into the medium for passage through the channel. In one form of the invention, the channel is formed of a pair of mating rings including an outer support ring and an inner ring, separated at a point along its circumference, mating with the outer ring to define said annular channel. According to this invention the inner ring is formed to have a radial thickness such that the distorting effects of centrifugal force on said inner ring are about balanced by the centrifugal pressure of said fluid medium.

BRIEF DESCRIPTION OF THE DRAWINGS

Further advantages and features of this invention will become apparent upon the following description wherein:

FIG. 1 is a simplified schematic representation of the sedimentation field flow fractionation technique;

DETAILED DESCRIPTION OF THE PREFERRED EMBODIMENT

Figure 2:
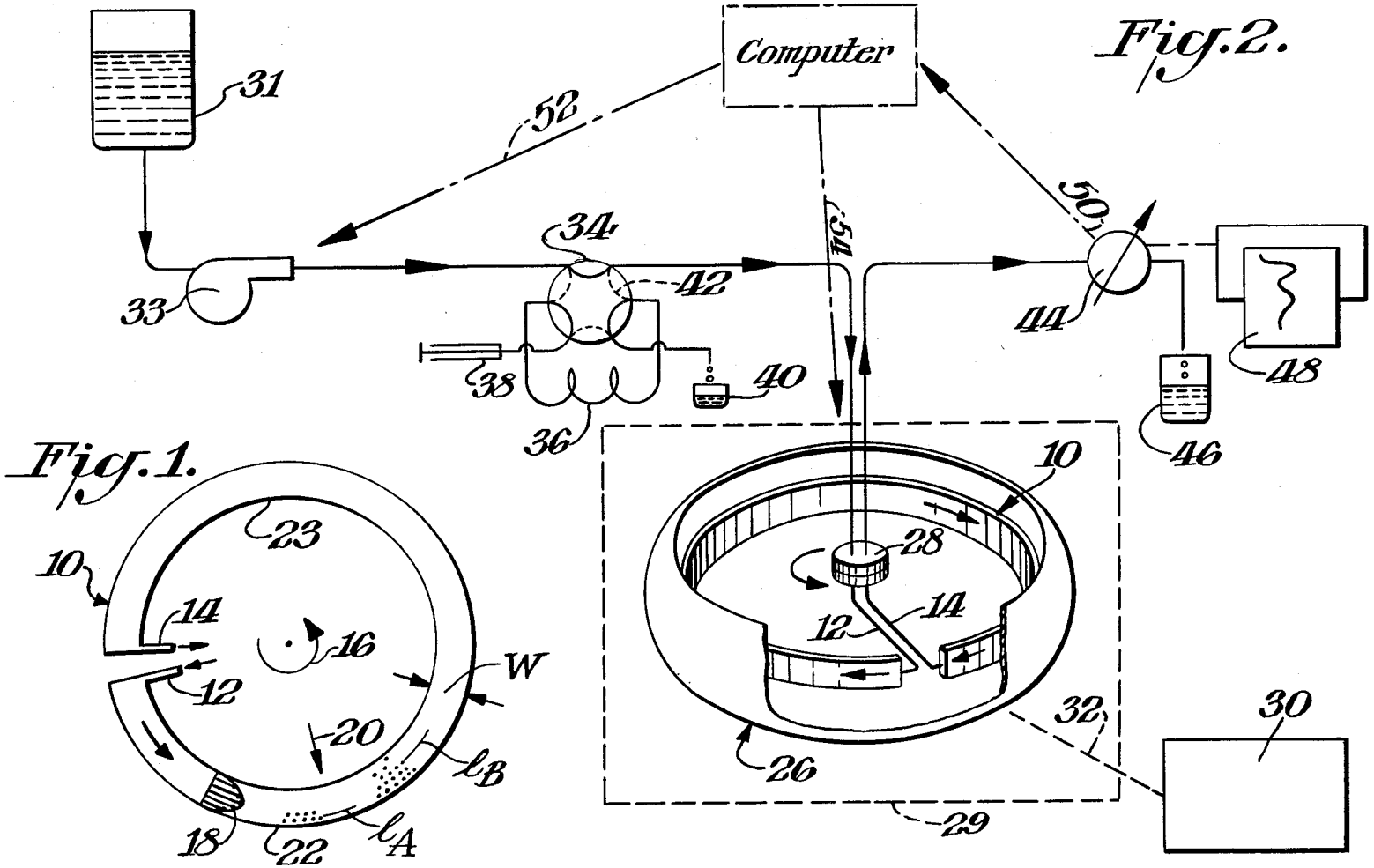
FIG. 2 is a partially schematic, partially pictorial representation of a particle separation apparatus constructed in accordance with this invention.

The principles of operation of a typical sedimentation field flow fractionation apparatus with which this invention finds use may perhaps be more easily understood with reference to FIGS. 1 and 2. In FIG. 1 there may be seen an annular ringlike (even ribbonlike) channel 10 having a relatively small thickness (in the radial dimension) designated W. The channel has an inlet 12 in which the mobile phase or liquid is introduced together with, at some point in time, a small sample of a particulate to be fractionated, and an outlet 14. The annular channel is spun in either direction. For purposes of illustration the channel is illustrated as being rotated in a counterclockwise direction denoted by the arrow 16. Typically these channels may be in the order of magnitude of 0.025 cm thick; actually, the smaller the channel thickness, the greater rate at which separations can be achieved and the greater the resolution of the separations.

In any event, because of the thin channel, the flow of the liquid is laminar and it assumes a parabolic flow velocity profile across the channel thicknesses, as denoted by the reference numeral 18. The channel 10 is defined by an outer surface or wall 22 and an inner surface or wall 23. If now a radial centrifugal force field F, denoted by the arrow 20, is impressed transversely, that is at right angles to the channel, particulates are compressed into a dynamic cloud with an exponential concentration profile, whose average height or distance from the outer wall 22 is determined by the equilibrium between the average force exerted on each particulate by the field F and by the normal opposing diffusion forces due to Brownian motion. Because the particuates are in constant motion at any given moment, any given particulate can be found at any distance from the wall. Over a long period of time compared to the diffusion time, every particulate in the cloud will have been at every different height from the wall many times. However, the average height from the wall of all of the individual particulates of a given mass over that time period will be the same. Thus, the average height of the particulates from the wall will depend on the mass of the particulates, larger particulates having an average height $\mathbf{1}_A$ (FIG. 1) and that is less than that of smaller particulates $\mathbf{1}_B$ (FIG. 1).

If one now causes the fluid in the channel to flow at a uniform speed, there is established a parabolic profile of flow 18. In this laminar flow situation, the closer a liquid layer is to the wall, the slower it flows. During the interaction of the compressed cloud of particulates with the flowing fluid, the sufficiently large particulates will interact with layers of fluid whose average speed will be less than the maximum for the entire liquid flow in the channel. These particulates then can be said to be retained or retarded by the field or to show a delayed elution in the field. This mechanism is described by Berg and Purcell in their article entitled "A Method For Separating According to Mass a Mixture of Macromolecules or Small Particles Suspended in a Fluid", I-Theory, by Howard C. Berg and Edward M. Purcell, Proceedings of the National Academy of Sciences, Vol. 58, No. 3, pages 862–869, September 1967.

According to Berg and Purcell, a mixture of macromolecules or small particulates suspended in a fluid may be separated according to mass, or more precisely what may be termed effective mass, that is, the mass of a particulate minus the mass of the fluid it displaces. If the particulates are suspended in the flowing fluid, they distribute themselves in equilibrium clouds whose scale heights, l, depend on the effective masses, $m_e$, through the familiar relation $m_e a = kT$. In this relationship k is Boltzmann's constant, T is the absolute temperature, and a is the centrifugal acceleration. In view of this differential transit time of the particulates through a relatively long column or channel, the particulates become separated in time and elute at different times. Thus, as may be seen in FIG. 1, a cluster of relatively small particulates $l_B$ is ahead of and elutes first from the channel, whereas a cluster of larger, heavier particulates $l_A$ is noticed to be distributed more closely to the outer wall 22 and obviously being subjected to the slower moving components of the fluid flow will elute at a later point in time.

As noted above, whenever channels are constructed for centrifugal applications the inner wall or surface 23 when subjected to centrifugal force as denoted by the arrow 20 tends to bow inwardly or outwardly along its axial dimensions. This is seen most clearly perhaps with the reference to FIG. 6 which depicts a partial or cross-sectional view of a split ring type channel of the type described in connection with FIGS. 2 through 5 below. Unfortunately this bow tends to produce a nonuniform velocity profile which reduces the resolution possible for the simple reason that particles at the same height such as particle $l_A$ do not all travel at the same speed through the channel. A further problem manifests itself in that the degree of bow of the inner wall 23 is a function of rotational speed of the centrifuge. This would tend to make the resolution not only decrease but to decrease by varying amounts depending upon rotational speed of the centrifuge rotor.

These problems are reduced in accordance with this invention by constructing the inner wall 23 of the flow channel 10 to have a thickness t that is related to the density of the fluid flowing through the channel, the radius of the channel, and the density of the material used to form the inner wall 23 of the channel. This relationship is more easily understood with reference to FIG. 6.

Figure 6:
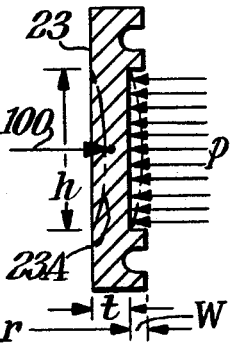
FIG. 6 is a diagramatic representation of the inner ring illustrating the fluid pressure and centrifugal forces acting thereon.

With particular reference to FIG. 6, if the inner wall 23, at radium r from the centerline of the axis of rotation, has the cross-sectional configuration as depicted therein, centrifugal force acts in the direction of the arrow 100 tending to produce a counter pressure to that of the channel fluid. The wall force $F_w$ acting on a wall elemental area dA can be express as wall mass times angular acceleration giving:

$$F_w = \rho_w t(r - \tfrac{1}{2}t)\omega^2 dA$$

where $\rho_w$ in the wall material density, $\omega$ is the rotational speed, and the term $(r - \frac{1}{2}t)$ is the radius of the center of gravity of the wall element of thickness t and area dA.

The opposing fluid pressure force $F_p$ is equal to the fluid pressure P acting over the same elemental area dA resulting in:

$$F_p = \tfrac{1}{2}\rho_F r^2 \omega^2$$

where $\rho_F$ is the fluid density, r is again the wall radius which is the radius of the fluid which is continuous from the centerline of rotation, and $\omega$ is the angular speed.

In accordance with this invention, when $F_p$ is equated with $F_w$ producing an equilibrium where the fluid force is equal to the wall force and solving the resulting equation for the desired wall thickness of the inner wall yields:

$$t = r\left(1 \pm \sqrt{1 - \frac{\rho_F}{\rho_w}}\right).$$

In the solution for their relationship, the negative root of the radical produces the desired minimal wall thickness $$t = r\left(1 - \sqrt{1 - \frac{\rho_F}{\rho_w}}\right),$$

choosing the positive root gives a wall thickness extending beyond the centerline of rotation which results in a rotor limiting the circumferential extent of the channel length.

If the inner channel wall thickness t is maintained, no bowing of the inner wall occurs and the channel thickness remains constant. This compensation is totally independent of rotational speed; hence the resolution of the channel remains high and band broadening or zone spreading is minimized regardless of rotational speed.

There is described in the copending Grant application a split ring channel having an extremely small, constant thickness dimension W to maintain resolution even in the presence of relatively large centrifugal force fields. The Grant apparatus, illustrated in FIG. 2 is particularly useful with this invention.

As seen in FIG. 2, the channel 10 may be disposed in a bowl-like or ring-like rotor 26 for support. The rotor 26 may be part of a conventional centrifuge, denoted by the dashed block 29, which includes a suitable centrifuge drive 30 of a known type operating through a suitable linkage 32, also a known type, whch may be direct belt or gear drive. Although a bowl-like rotor is illustrated, it is to be understood that the assembly of channel 10 and rotor 26 may be supported for rotation about its own cylinder axis by any suitable means such as a spider (not shown), simple bowl, or disk, etc. The channel has a liquid or fluid inlet 12 and an outlet 14 which is coupled through a rotating seal 28, of conventional design, to the stationary apparatus which comprise the rest of the system. Thus the inlet fluid (or liquid) or mobile phase of the system is derived from suitable solvent reservoirs 30 which are coupled through a conventional pump 32 thence through a two-way, 6-port sampling valve 34 of conventional design through a rotating seal 28, also of conventional design, to the inlet 12.

Samples whose particulates are to be separated are introduced into the flowing fluid stream by this conventional sampling valve 34 in which a sample loop 36 has either end connected to opposite ports of the valve 34 with a syringe 38 being coupled to an adjoining port. An exhaust or waste receptacle 40 is coupled to the final port. When the sampling valve 34 is in the position illustrated by the solid lines, sample fluid may be introduced into the sample loop 36 with sample flowing through the sample loop to the exhaust receptacle 40. Fluid from the solvent reservoirs 30 in the meantime flows directly through the sample valve 34. When the sample valve 34 is changed to a second position, depicted by the dashed lines 42, the ports move one position such that the fluid stream from the reservoir 30 now flows through the sample loop 36 before flowing to the rotating seal 28. Conversely the syringe 38 is coupled directly to the exhaust reservoir 40. Thus the sample is carried by the fluid stream to the rotating seal 28.

The outlet line 14 from the channel 10 is coupled through the rotating seal 28, through the rotor channel 10, out through the rotating seal 28, to a conventional detector 44 and thence to an exhaust or collector receptacle 46. The detector may be any of the conventional types, such as an ultraviolet absorption or a light scattering detector. In any event, the analog electrical output of this detector may be connected as desired to a suitable recorder 48 of known type and in addition may be connected as denoted by the dashed line 50 to a suitable computer for analyzing this data. At the same time this system may be automated, if desired, by allowing the computer to control the operation of the pump 32 and also the operation of the centrifuge 28. Such control is depicted by the dashed lines 52 and 54, respectively.

Figure 3:
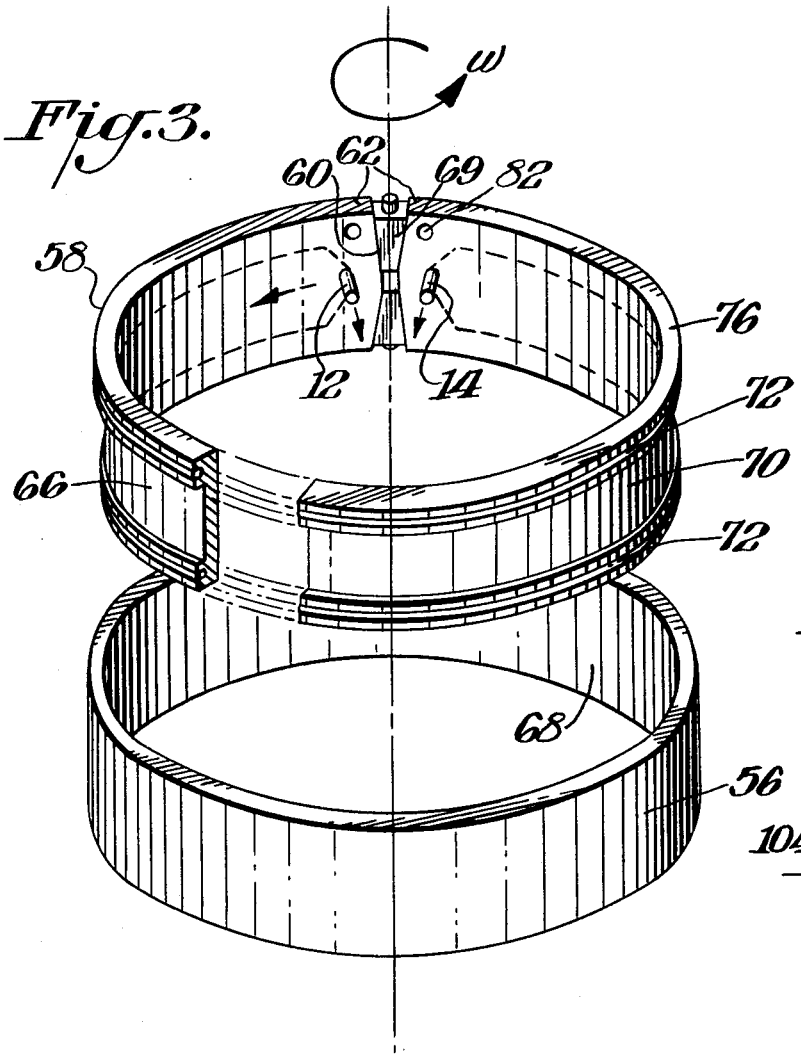
FIG. 3 is an exploded pictorial representation of the mating split rings used to form the channel of this invention.
Figure 4:
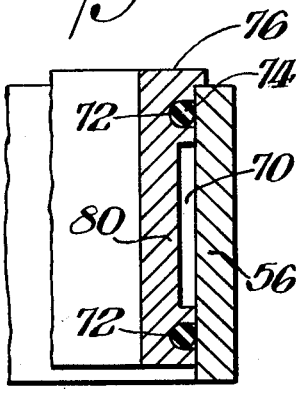
FIG. 4 is a cross sectional view of the mating split rings depicted in FIG. 3.
Figure 5:
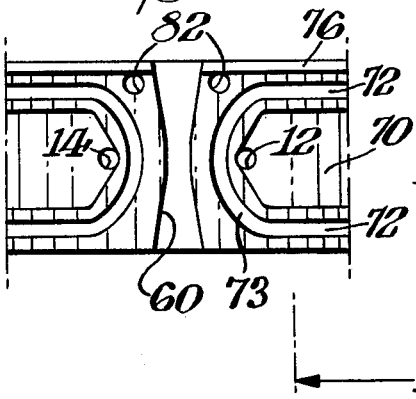
FIG. 5 is a partial pictorial representation of one end of the inner ring, particularly depicting the seal.

The channel 10 of the Grant apparatus has a configuration as is particularly depicted in FIGS. 3, 4 and 5. It is annular in configuration such that fluid flows circumferentially through the channel. The channel is comprised particularly of an outer ring 56, which is in the form of a band having a constant radius, and functions to provide strength to support an inner ring. Actually, the outer ring may be supported by a spider, bowl or disc which is driven directly by the centrifuge drive 32 (FIG. 2). Alternatively, the outer ring may be eliminated and the bowl rotor substituted. In the event, the bowl rotor has a flattened inner surface formed thereon to provide the outer channel wall. The outer ring need not be separately mounted inside a support structure (26 of FIG. 2).

The inner ring 58 is split, i.e., its longitudinal circumference is divided or separated to have a gap 60 with the longitudinal ends 62 of the inner ring 58 slightly tapered so as to facilitate the use of a wedge 69. The wedge 69 retains the inner ring sufficiently expanded so as to maintain contact with the outer ring 56 at all times even when stopped. In accordance with this invention the thickness of the inner ring (FIG. 6) is selected in accordance with the above-noted relationship, i.e., it is directly proportional to the inside wall radius times the quantity $$\left(1-\sqrt{1-\frac{\rho_F}{\rho_s}}\right).$$

An entire range of inner rings 80 may e constructed for use with a single outer ring 50 (or rotor if the outer ring is the rotor), a different thickness being used in the manufacture of each inner ring to accommodate different solvents that may be used in the flow channel. Alternatively a single inner ring may be constructed whose thickness t represents a compromise thickness lying in the middle of the range of solvents to be used. The radially outer wall 66 of the inner ring 58 and the radially inner wall 68 of the outer ring 56 are formed to have a microfinish. This may be accomplished by polishing, for example, or by coating the surfaces with a suitable material either directly or by use of an insert. This smooth finish tends to reduce the possibility that particles will stick to the walls or become entrapped in small crevices or depressions of a depth equal to average concentration depth l of the particle cloud and also insures that the expected sample retention takes place.

Depending upon the needs of the operation, a groove 70 may be formed in the outer wall 66 of the inner ring 58 so as to form the flow channel itself or the conduit itself through which the fluid may flow. Along edges of the main groove 70, subsidiary grooves 72 may be formed to accommodate a resilient seal 74 such as an O-ring which completely surrounds and tracks along the entire edges of the channel, including the end sections as may be seen most clearly in FIG. 5. Actually, at the end sections the groove is generally curved as at 73. Additionally, the upper edge of the inner ring is formed with a radial outwardly extending flange 76, as is seen most clearly in FIG. 4, such that the inner ring may rest upon and be supported by the outer ring against axially downward displacement. This then permits the formation of the narrow flow passage or channel itself which may be designated by the reference numeral 80 as is seen most clearly in FIG. 4. As noted, the thickness W of this channel 80 is relatively small, typically being in the order of 0.1 cm or less.

To complete the channel construction, either end of the channel 80 is provided with an inlet orifice 12 in the form of a bore through the inner ring and an outlet orifice 14, also in the form of a bore through the inner ring 58. If desired, spanner holes 82 may be formed in the inner ring to facilitate disassembly of the channel.

Figure 7:
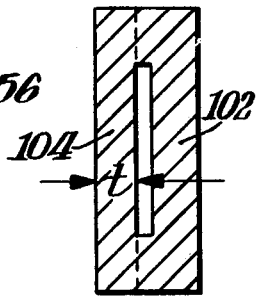
FIG. 7 is a cross-sectional view of another form of channel that may be used in this invention.

In an alternative embodiment of the invention, the flow channel 10 may be constructed as depicted in FIG. 7 of a unitary channel, i.e., the inner and outer walls may be welded or joined together by other suitable means. In this case the unitary channel depicted by the numeral 102 has an inner wall 104 whose thickness t is selected in accordance with the above relationships. In any event, this channel 102 is split such that it may, as depicted in FIG. 2, fit within a bowl type rotor or on a spider as peviously described with the inlet and outlet lines 12 and 14 connected to either end.

There has thus been described a relatively simple apparatus capable of maintaining channel thickness relatively constant despite centrifugal forces impinging thereon. The principals of this invention are equally applicable to a flow channel of the type described by Berg and Purcell wherein fluid flow is axial rather than circumferential.

I claim:

1. An apparatus for separating particulates suspended in a fluid medium according to their effective masses, said apparatus having an annular cylindrical channel with a cylinder axis, means for rotating said channel about said axis, means for passing said fluid medium circumferentially through said channel, and means for introducing said particulates into said medium for passage through said channel, said channel having an outer support ring and an inner ring separated at a point along its circumference mating with said outer ring to define said channel, the improvement wherein:

said inner ring has a radial thickness such that the distorting effects of centrifugal force on said inner ring are about balanced by the centrifugal pressure of said fluid medium.

2. An apparatus according to claim 1 wherein said inner ring radial thickness t is defined by the relation:

$$t=r\left(1-\sqrt{1-\frac{\rho_F}{\rho_w}}\right)$$

where $\rho_F$ is the density of the fluid medium, $\rho_w$ is the density of the wall material of the inner ring, and r is the radius of the inner wall of the channel.

3. An apparatus for separating particulates suspended in a fluid medium according to their effective masses, said apparatus having an annular channel with a cylinder axis, said channel having radially inner and outer walls, means for rotating said channel about said axis, means for passing said fluid medium through said channel, means for introducing said particulates into said medium for passage through said channel, the improvement wherein:

said inner wall has a radial thickness such that the distorting effects of centrifugal force on said inner ring are about balanced by the centrifugal pressure of said fluid medium.

4. An apparatus according to claim 3 wherein said inner wall radial thickness t is defined by the relation:

$$t=r\left(1-\sqrt{1-\frac{\rho_F}{\rho_w}}\right)$$

where $\rho_F$ is the density of the fluid medium, $\rho_w$ is the density of said inner wall material, and r is the radius of the inner wall of the channel surface.

* * * * *